US008056238B2

(12) United States Patent
Van Eibergen Santhagens et al.

(10) Patent No.: US 8,056,238 B2
(45) Date of Patent: Nov. 15, 2011

(54) SHAVING HEAD HAVING A BLADE SUPPORTING MEMBER WITH REDUCED CROSS-SECTIONAL AREA

(75) Inventors: Robert Alexander Van Eibergen Santhagens, Drachten (NL); Ype Bernardus Brada, Drachten (NL); Willem Auke Westerhof, Drachten (NL); Hette Akkerman, Drachten (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 624 days.

(21) Appl. No.: 10/588,433

(22) PCT Filed: Jan. 26, 2005

(86) PCT No.: PCT/IB2005/050310

§ 371 (c)(1),
(2), (4) Date: Aug. 4, 2006

(87) PCT Pub. No.: WO2005/075161

PCT Pub. Date: Aug. 18, 2005

(65) Prior Publication Data

US 2007/0209206 A1 Sep. 13, 2007

(30) Foreign Application Priority Data

Feb. 5, 2004 (EP) ..... 04100436

(51) Int. Cl.
*B26B 21/00* (2006.01)

(52) U.S. Cl. ..... 30/50; 30/40; 30/40.2

(58) Field of Classification Search ..... 30/50, 40, 30/40.2

See application file for complete search history.

(56) References Cited

U.S. PATENT DOCUMENTS 4,492,024 A 1/1985 Jacobson et al.
5,822,862 A * 10/1998 Ferraro ..... 30/50
6,243,951 B1 6/2001 Oldroyd
6,671,961 B1 1/2004 Van Eibergen et al.
6,941,659 B2 * 9/2005 Gilder ..... 30/34.2
7,131,202 B2 * 11/2006 Pennell et al. ..... 30/50

(Continued)

FOREIGN PATENT DOCUMENTS

EP 1265405 A1 7/2002

(Continued)

OTHER PUBLICATIONS

Koon-Seok Lee, et al., "A New Control Protocol for Home Appliances—LnCP," in International Symposium on Industrial Electronics, 2001, Proceedings, ISIE 2001, Jun. 2001, pp. 286-291.

(Continued)

*Primary Examiner* — Joseph J Hail
*Assistant Examiner* — Shantese McDonald

(57) ABSTRACT

The invention relates to a shaving head (5) comprising at least two bladeshaped cutting members (7, 7', 7") each having a straight cutting edge (9, 9', 9") extending parallel to a longitudinal direction (Y) of the shaving head. Each cutting member is supported in a cartridge (11) of the shaving head by means of a supporting member (17) which supports the respective cutting member in a supported area (23) on the respective cutting member. Said supported area extends over a predetermined distance (D) perpendicular to the longitudinal direction. Each supporting member has a first portion (25) in contact with the supported area at a location remote from the cutting edge of the respective cutting member and a second portion (27) in contact with the supported area at a location near the cutting edge of the respective cutting member. The first portion has a basic cross-sectional area, seen perpendicularly to the longitudinal direction, and the second portion has a reduced cross-sectional area. According to the invention, the second portion (27) of the supporting member (17) of at least one of the cutting members (7, 7', 7") extends over at least half of said predetermined distance (D). In this manner, the free space between two adjacent cutting members is considerably increased. As a result, the rinsability of the shaving head is improved, so that the risk of shaving debris accumulation between two adjacent cutting members is reduced.

6 Claims, 4 Drawing Sheets

U.S. PATENT DOCUMENTS

Figure 1:
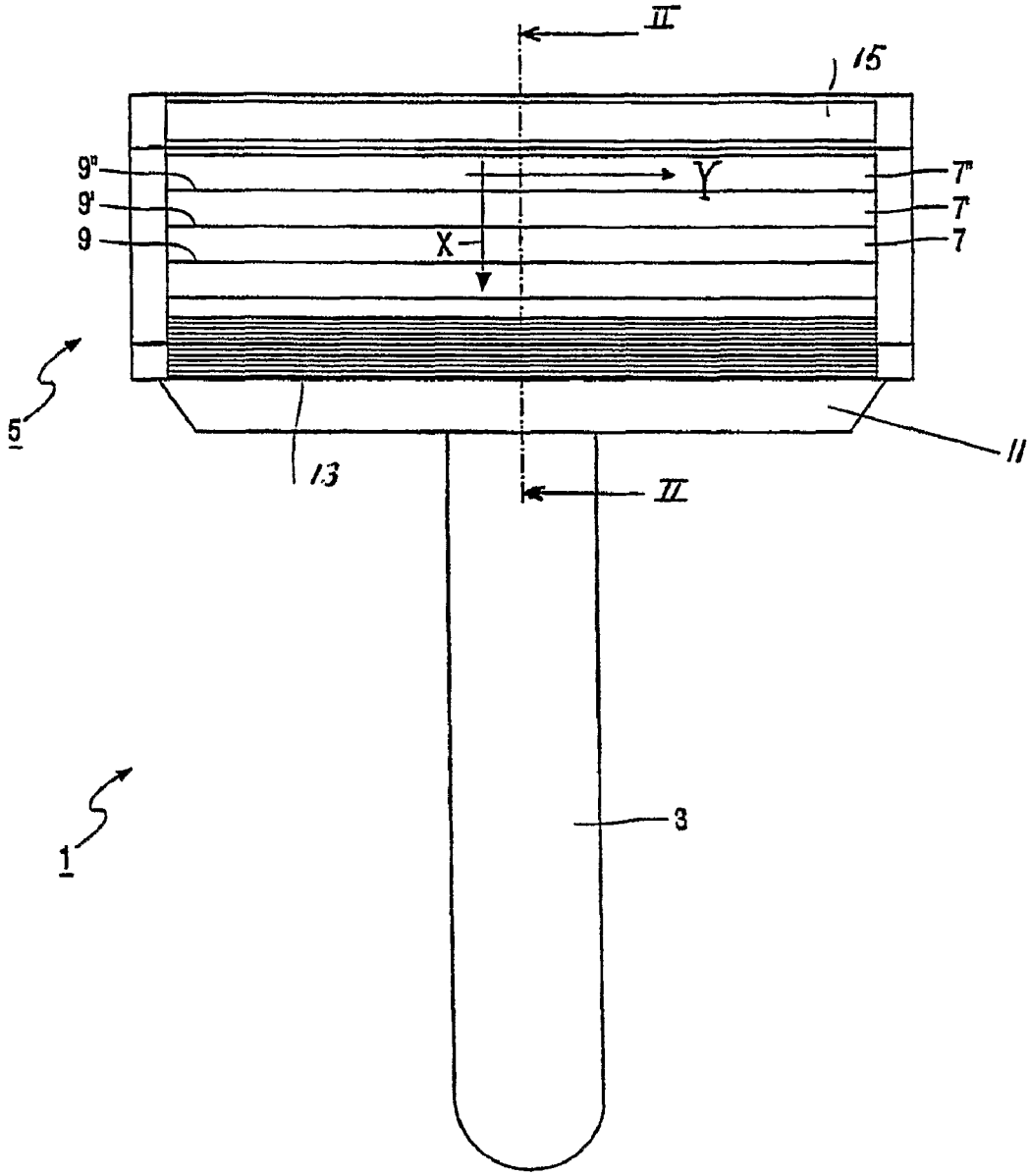

| | | | |
|---|---|---|---|
| 2003/0074460 | A1 | 4/2003 | Soemo et al. |
| 2003/0088703 | A1 | 5/2003 | Kim |

FOREIGN PATENT DOCUMENTS

| | | | |
|---|---|---|---|
| WO | WO 01/39937 | * | 6/2001 |
| WO | WO 2004/069495 | | 8/2004 |

OTHER PUBLICATIONS

Koon-Seok Lee, et al., "Network Configuration Technique for Home Appliances based on LnCP." IEEE Transactions on Consumer Electronics, IEEE Service Center, New York, vol. 49, Issue 2, May 2003, pp. 367-374.

* cited by examiner

SHAVING HEAD HAVING A BLADE SUPPORTING MEMBER WITH REDUCED CROSS-SECTIONAL AREA

The invention relates to a shaving head comprising at least two blade-shaped cutting members each having a straight cutting edge extending parallel to a longitudinal direction of the shaving head, each cutting member being supported in a cartridge of the shaving head by means of a supporting member supporting the respective cutting member in a supported area on the respective cutting member, said supported area extending over a predetermined distance perpendicular to the longitudinal direction, and each supporting member having a first portion in contact with said supported area remote from the cutting edge of the respective cutting member and a second portion in contact with said supported area near the cutting edge of the respective cutting member, said first portion having a basic cross-sectional area, seen perpendicularly to the longitudinal direction, and said second portion having a reduced cross-sectional area.

The invention also relates to a shaving device having a grip and a shaving head releasably mounted to a grip.

A shaving head and a shaving device of the kinds mentioned in the opening paragraphs are known from U.S. Pat. No. 6,243,951 B1. The known shaving head comprises three blade-shaped cutting members or cutting blades having parallel cutting edges. The supporting members, by means of which the cutting blades are supported in the cartridge of the shaving head, each comprise a longitudinally extending upright beam portion from the upper edge of which extends a forwardly and upwardly inclined blade platform against the upper surface of which the respective cutting blade is fixed. The blade platform is provided with a plurality of uniformly spaced apart comb elements or teeth, which extend perpendicularly to the cutting edge of the respective cutting blade and project forward relative to the cutting edge. The projecting teeth have a guiding effect influencing the shaving head to move over the skin in a direction perpendicularly to the cutting edges of the cutting blades, as a result of which the safety and comfort of the shaving head are enhanced. The base portions of the teeth are in contact with a relatively small portion of the supported area in which the supporting member supports the respective cutting blade. Accordingly, said base portions constitute said second portion of the supporting member, which has a reduced cross-sectional area relative to the basic cross-sectional area of the first portion of the supporting member as a result of the indentations formed between the teeth.

A disadvantage of the known shaving head and shaving device is that during use shaving debris accumulates in the relatively narrow spaces between the blade-shaped cutting members. Because of said relatively narrow spaces, the shaving head is badly rinsable, so that it is difficult or even impossible to clean the shaving head after use. As a result of said accumulation of shaving debris, the shaving performance and shaving comfort of the shaving head are affected.

It is an object of the invention to provide a shaving head and a shaving device of the kinds mentioned in the opening paragraphs which are better rinsable, so that the risk of shaving debris accumulation between the blade-shaped cutting members is reduced.

In order to achieve this object a shaving head in accordance with the invention is characterized in that the second portion of the supporting member of at least one of the cutting members extends over at least half of said predetermined distance.

In order to achieve this object a shaving device in accordance with the invention is characterized in that the shaving head used therein is a shaving head in accordance with the invention.

The supporting member of said at least one of the cutting members is present in the space between said at least one of the cutting members and the cutting member which precedes said at least one of the cutting members seen in the cutting direction. Since the second portion of said supporting member having the reduced cross-sectional area extends over at least half of the predetermined distance over which, seen perpendicularly to the longitudinal direction, the supporting member supports the cutting member, the free space between said cutting members is considerably increased. As a result, the space between said cutting members is better rinsable, so that shaving debris accumulated in said space during use can be better removed by rinsing the shaving head after use. Alternatively, the blade-shaped cutting members and the cutting edges can be arranged in the cartridge at smaller mutual distances without inadmissibly affecting the rinsability of the shaving head. As a result of said smaller mutual distances the shaving comfort of the shaving head is increased and the risk of skin irritation and skin damage is reduced.

A particular embodiment of a shaving head in accordance with the invention is characterized in that the second portion of the supporting member of each cutting member extends over at least half of said predetermined distance. In this embodiment, identical supporting members are used for the cutting members, so that the structure and manufacturing process of the shaving head are simplified.

A particular embodiment of a shaving head in accordance with the invention is characterized in that the second portion is a wedge-shaped portion. The wedge-shaped portion provides a gradual and smooth contour of the free space between the cutting members, so that both the rinsability of said space is further improved and the risk of accumulation of shaving debris in said space during use is reduced.

A particular embodiment of a shaving head in accordance with the invention is characterized in that the second portion is a toothed portion. In this embodiment, an improved rinsability of the space between the cutting members is achieved in particular as a result of an improved rinsability of the free portions of said space present between the individual teeth of the toothed portion.

A further embodiment of a shaving head in accordance with the invention is characterized in that the toothed portion comprises wedge-shaped teeth. The wedge-shaped teeth further improve the rinsability of a shaving head comprising supporting members with toothed portions.

Figure 2:
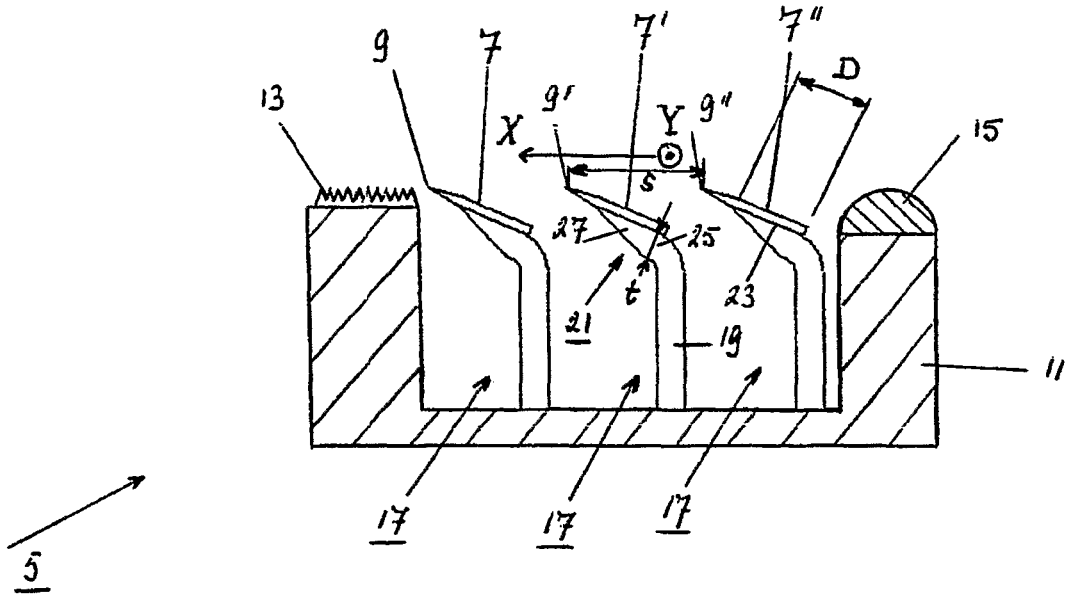
Figure 3:
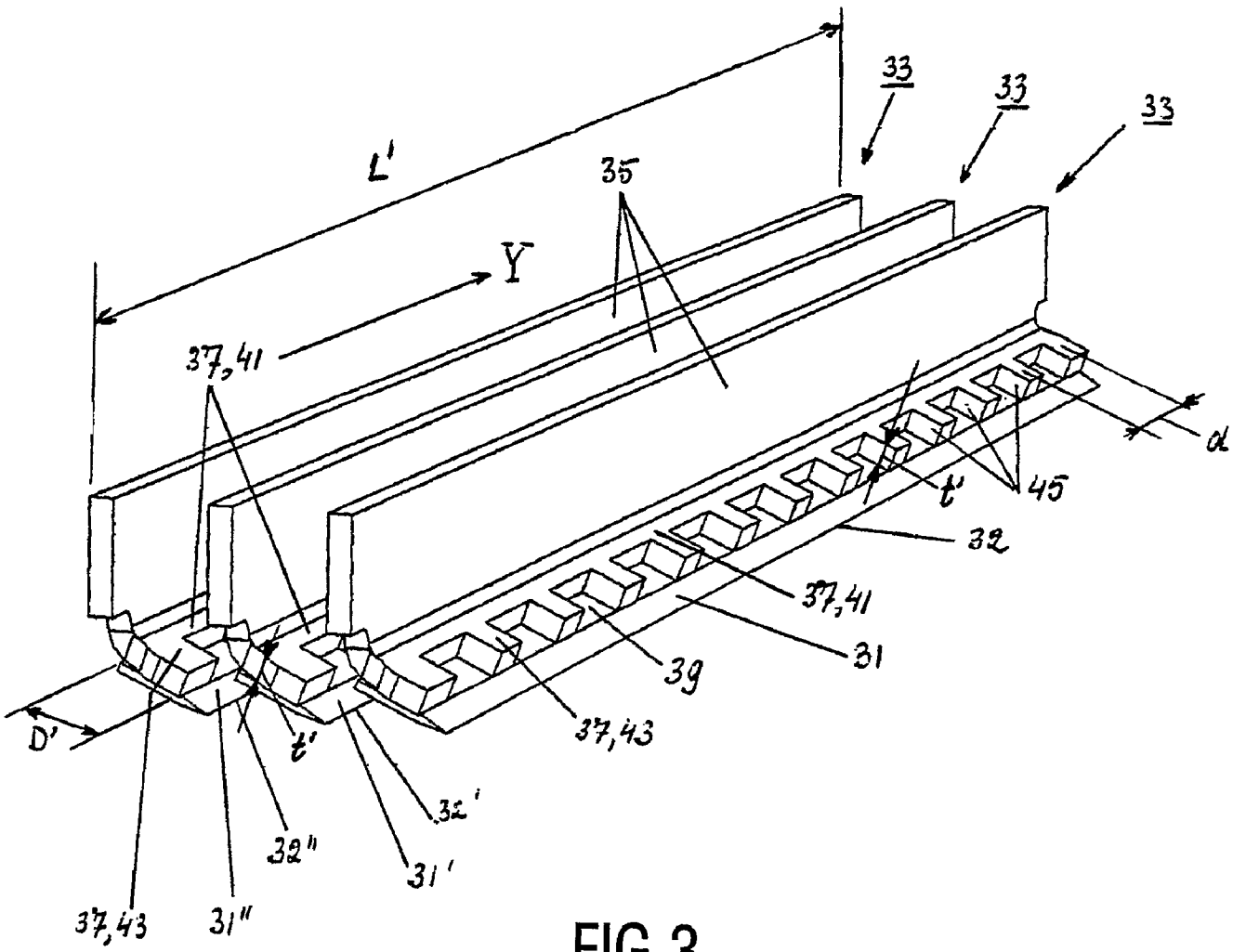
Figure 4:
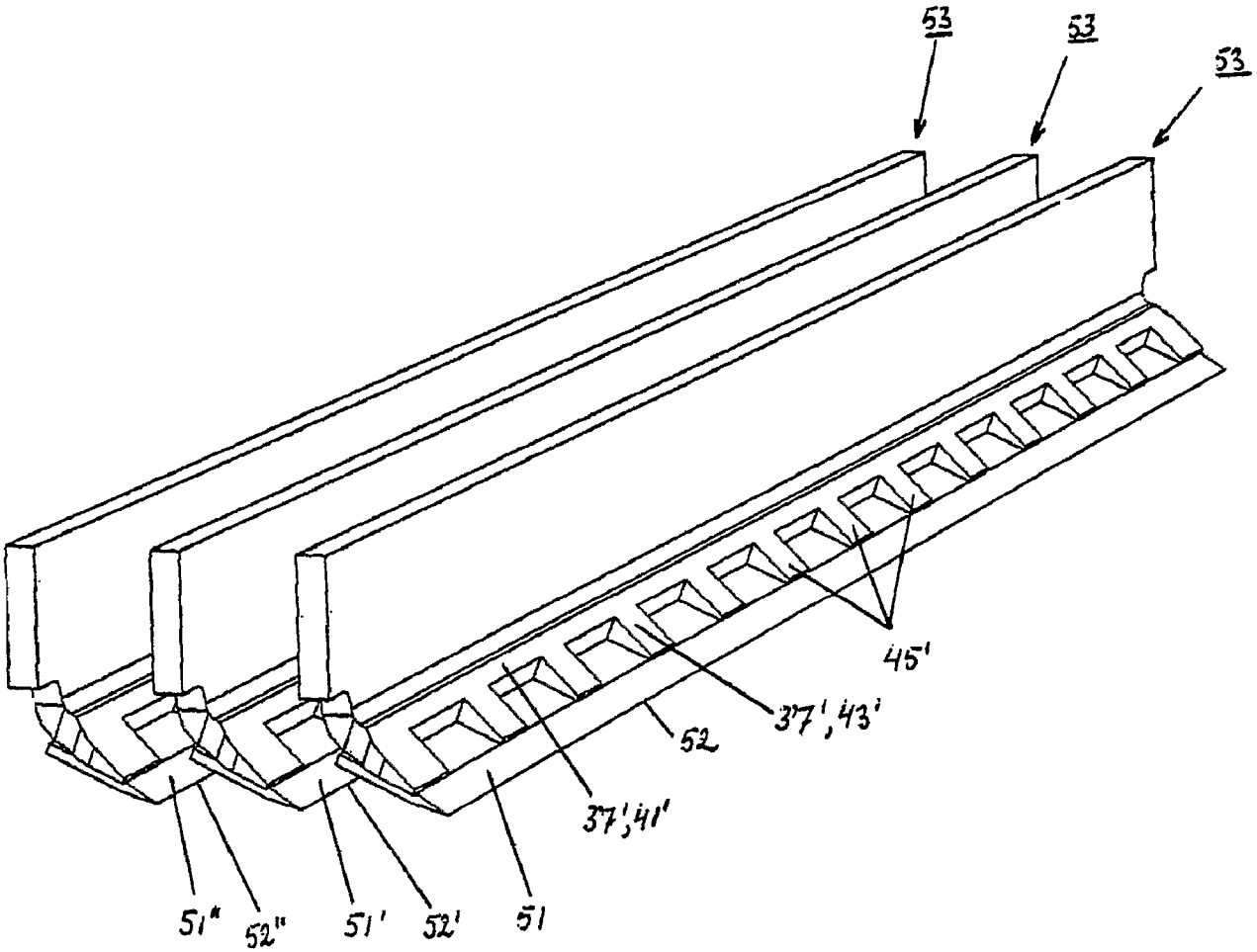

Embodiments of a shaving head and a shaving device in accordance with the invention will be described in detail hereafter with reference to the Figures, in which FIG. 1 schematically shows a shaving device in accordance with the invention which is provided with a first embodiment of a shaving head in accordance with the invention;

FIG. 2 schematically shows a cross-section along the line II-II in FIG. 1;

FIG. 3 shows three cutting members and three supporting members of a second embodiment of a shaving head in accordance with the invention; and FIG. 4 shows three cutting members and three supporting members of a third embodiment of a shaving head in accordance with the invention.

FIG. 1 schematically shows a shaving device 1 in accordance with the invention. The shaving device 1 comprises a grip 3 and a first embodiment of a disposable shaving head 5 in accordance with the invention. The shaving head 5 is releasably mounted to the grip 3 by means of mechanical coupling means which are not visible in FIG. 1.

In the embodiment shown, the shaving head 5 comprises three blade-shaped cutting members 7, 7', 7" which are each provided with a straight cutting edge 9, 9', 9". The cutting edges 9, 9', 9" extend parallel to a longitudinal direction Y of the shaving head 5 and define a cutting or shaving direction X of the shaving head 5, which is directed perpendicularly to the longitudinal direction Y. The cutting members 7, 7', 7" are supported in a cartridge 11 of the shaving head 5 in a manner to be described in detail hereafter. The cartridge 11 further carries a profiled skin stretching element 13, which precedes the cutting members 7, 7', 7" seen in the cutting direction X, and a skin lubricating element 15, which follows the cutting members 7, 7', 7" seen in the cutting direction X. The skin stretching element 13 and the skin lubricating element 15 together define a skin contact surface via which the shaving head 5 abuts against the skin during use of the shaving device 1.

As shown in FIG. 2, the cutting members 7, 7', 7" are each supported in the cartridge 11 of the shaving head 5 by means of a supporting member 17. In the first embodiment of the shaving head 5 shown in FIG. 2, the supporting members 17 are identical and extend parallel to the longitudinal direction Y over substantially the complete length of the cutting members 7, 7', 7", the supporting members 17 having an identical cross-section in every imaginary plane extending perpendicularly to the longitudinal direction Y. Each supporting member 17 has a base portion 19, which is connected to the cartridge 11 and extends transversely relative to the respective cutting member 7, 7', 7" it supports, and a supporting platform 21, which is inclined relative to the base portion 19 and to which the respective cutting member 7, 7', 7" is attached. As shown in FIG. 2, each supporting member 17 supports the respective cutting member 7, 7', 7" in a supported area 23 on the lower side of the respective cutting member 7, 7', 7", said supported area 23 extending over a predetermined distance D in a direction perpendicular to the longitudinal direction Y and, in the embodiment shown, extending over substantially the complete length of the respective cutting member 7, 7', 7" seen in the longitudinal direction Y.

As shown in FIG. 2, the supporting platform 21 of each supporting member 17 has a first portion 25, via which the supporting member 17 is in contact with the supported area 23 of the respective cutting member 7, 7', 7" at a location remote from the cutting edge 9, 9', 9" of the respective cutting member 7, 7', 7", and a second portion 27, via which the supporting member 17 is in contact with the supported area 23 of the respective cutting member 7, 7', 7" at a location close to the cutting edge 9, 9', 9" of the respective cutting member 7, 7', 7". The first portion 25 has a uniform thickness t. As a result, seen in a direction perpendicular to the longitudinal direction Y, the first portion 25 has a uniform rectangular cross-section with a basic cross-sectional area t*L, wherein L is the length of the supporting member 17 in the longitudinal direction Y. In the first embodiment of the shaving head 5, the second portion 27 has a wedge-shaped cross-section seen in an imaginary plane extending perpendicularly to the longitudinal direction Y. Accordingly, seen in a direction perpendicular to the longitudinal direction Y, the second portion 27 has a rectangular cross-section which gradually decreases from the first portion 25 towards the cutting edge 9, 9', 9" and which accordingly has a reduced cross-sectional area relative to the basic cross-sectional area of the first portion 25.

As shown in FIG. 2, the second wedge-shaped portion 27 of each supporting member 17 extends over at least half of the predetermined distance D over which the supported area 23 of the respective cutting member 7, 7', 7" extends in a direction perpendicular to the longitudinal direction Y. In the embodiment shown in FIG. 2 the second wedge-shaped portion 27 extends over approximately 80% of the distance D. Accordingly, in this embodiment the first portion 25 of each supporting member 17 extends over only approximately 20% of the distance D. As a result, seen in a direction perpendicular to the Y-direction, the supporting members 17 have a considerably reduced average cross-sectional area at locations where the supporting members 17 are present in the relatively narrow spaces between the cutting members 7, 7', 7". As a result, the free space between the cutting members 7, 7', 7" is considerably increased. As a result, the rinsability of the spaces between the cutting members 7, 7', 7" is considerably improved, so that the risk of shaving debris accumulation in said spaces during use is reduced and the shaving debris, which still accumulates in said spaces during use, can be relatively easily removed after use by rinsing the shaving head 5.

In the first embodiment of the shaving head 5 shown in FIG. 2, the wedge-shaped second portions 27 of the supporting members provide a gradual and smooth contour of the spaces between the cutting members 7, 7', 7". Said gradual and smooth contour further improves the rinsability of said spaces and further reduces the risk of shaving debris accumulation in said spaces during use. In this embodiment, the supporting members 17 are mutually identical. This simplifies the structure and the manufacturing process of the shaving head 5.

It is further noted that the advantageous effect of a shaving head in accordance with the invention can also be exploited in a different manner. In particular, the mutual distances s (see FIG. 2) between the cutting members 7, 7', 7" can be reduced compared to a conventional shaving head like the shaving head known from U.S. Pat. No. 6,243,951 B1. In this manner, a remarkable improvement of the rinsability can still be obtained. An important advantage of the reduced mutual distances s is that the risk of skin irritations and skin damages is reduced, so that the shaving comfort of the shaving head is strongly improved. By optimizing the mutual distances s, an optimum or other desired combination of the rinsability and the shaving comfort of the shaving head can be achieved.

FIG. 3 shows three cutting members 31, 30', 31" with parallel cutting edges 32, 32', 32" and three supporting members 33 of a second embodiment of a shaving head in accordance with the invention. Apart from the supporting members 33 the second embodiment of the shaving head corresponds to the first embodiment of the shaving head 5. For this reason the other parts of the second embodiment of the shaving head are not shown in FIG. 3 and will not be discussed hereafter.

As shown in FIG. 3, the supporting members 33 are identical and extend parallel to the longitudinal direction Y over substantially the complete length of the cutting members 31, 31', 31". Each supporting member 33 has a base portion 35, which is connected to the cartridge of the shaving head and extends transversely relative to the respective cutting member 31, 31', 31" it supports, and a supporting platform 37, which is inclined relative to the base portion 35 and to which the respective cutting member 31, 31', 31" is attached. Each supporting member 33 supports the respective cutting member 31, 31', 31" in a supported area 39 on the upper side of the respective cutting member 31, 31', 31" seen in the position of the cutting members 31, 31', 31" shown in FIG. 3, said supported area 39 extending over a predetermined distance D' in a direction perpendicular to the longitudinal direction Y and extending over substantially the complete length of the respective cutting member 31, 31', 31" seen in the longitudinal direction Y.

The supporting platform 37 of each supporting member 33 has a first portion 41, via which the supporting member 33 is in contact with the supported area 39 of the respective cutting member 31, 31', 31" at a location remote from the cutting edge 32, 32', 32" of the respective cutting member 31, 31', 31", and a second portion 43, via which the supporting member 33 is in contact with the supported area 39 of the respective cutting member 31, 31', 31" at a location close to the cutting edge 32, 32', 32" of the respective cutting member 31, 31', 31". The first portion 41 has a uniform thickness t'. As a result, seen in a direction perpendicular to the longitudinal direction Y, the first portion 41 has a uniform rectangular cross-section with a basic cross-sectional area t'*L', wherein L' is the length of the supporting member 33 in the longitudinal direction Y. In the second embodiment of the shaving head, the second portion 43 is a toothed portion having an array of teeth 45 with a uniform thickness t' identical to the thickness of the first portion 41 and with a constant mutual distance d. Accordingly, seen in a direction perpendicular to the longitudinal direction Y, the second portion 43 has a cross-section with a reduced cross-sectional area relative to the basic cross-sectional area of the first portion 41. For example, in an embodiment wherein the teeth 45 each have a width equal to the width of their mutual interspaces, said cross-sectional area of the second portion 43 will be approximately half of said cross-sectional area of the first portion 41.

As shown in FIG. 3, the second toothed portion 43 of each supporting member 33 extends over at least half of the predetermined distance D' over which the supported area 39 of the respective cutting member 31, 31', 31" extends in a direction perpendicular to the longitudinal direction Y. In the embodiment shown in FIG. 3 the second toothed portion 43 extends over approximately 70% of the distance D'. Accordingly, in this embodiment the first portion 41 of each supporting member 33 extends over only approximately 30% of the distance D'. As a result, seen in a direction perpendicular to the Y-direction, the supporting members 33 have a considerably reduced average cross-sectional area at locations where the supporting members 33 are present in the relatively narrow spaces between the cutting members 31, 31', 31". As a result, like in the first embodiment of the shaving head 5 described here before, the rinsability of the second embodiment of the shaving head is considerably improved, and the risk of shaving debris accumulation in the spaces between the cutting members 31, 31', 31" is reduced. In the second embodiment, an improved rinsability of the spaces between the cutting members 31, 31', 31" is achieved in particular as a result of an improved rinsability of the portions of said spaces which are present between the individual teeth 45 of the toothed portion 43.

FIG. 4 shows three cutting members 51, 51', 51" with parallel cutting edges 52, 52', 52" and three supporting members 53 of a third embodiment of a shaving head in accordance with the invention. Apart from the supporting members 53 the third embodiment of the shaving head corresponds to the first embodiment of the shaving head 5. For this reason the other parts of the third embodiment of the shaving head are not shown in FIG. 4 and will not be discussed hereafter. In FIG. 4, parts of the third embodiment of the shaving head, which correspond to parts of the second embodiment of the shaving head described herebefore, are indicated by corresponding reference numbers.

As shown in FIG. 4, the supporting members 53 in the third embodiment of the shaving head mainly differ from the supporting members 33 in the second embodiment of the shaving head in that the teeth 45' of the second toothed portions 43' of the supporting members 53 are wedge-shaped. The result of the wedge-shape of the teeth 45' is that the rinsability of the third embodiment of the shaving head is further improved, and the risk of shaving debris accumulation in the spaces between the cutting members 51, 51', 51" is further reduced.

It is noted that in each embodiment of a shaving head in accordance with the invention described here before, the three supporting members 17, 33, 53 are mutually identical. In this manner the shaving head has a simple structure, and the free space between each pair of adjacent cutting members is increased. The invention generally covers embodiments in which the free space between at least one pair of adjacent cutting member is increased. For this reason, in each embodiment of a shaving head in accordance with the invention at least one of the cutting members has a supporting member with a second portion with a reduced cross-sectional area extending over at least half of the predetermined distance over which the supporting member is in contact with the supported area on the cutting member. The supporting member of the cutting member, which is arranged in front, is not present in a space between two adjacent cutting members and, accordingly, does not necessarily need to have a second portion with a reduced cross-sectional area in order to provide improved rinsability of the shaving head.

It is further noted that the invention also covers embodiments of a shaving head having a different number of cutting members, for example two or four cutting members.

It is finally noted that the invention also covers embodiments in which the supporting members do not support the cutting members over their complete length seen in the longitudinal direction Y. A shaving head may, for example, comprise a number of supporting members for each cutting member arranged at regular mutual intervals seen in the longitudinal direction Y. In such an alternative embodiment, the invention improves at least the rinsability of the shaving head at locations between the cutting members close to the supporting members.

The invention claimed is:

1. A shaving head comprising at least two blade-shaped cutting members each having a straight cutting edge extending parallel to a longitudinal direction of the shaving head, each cutting member being supported in a cartridge of the shaving head by a supporting member supporting the respective cutting member in a supported area on the respective cutting member, said supported area extending over a predetermined distance perpendicular to the longitudinal direction, and each supporting member having a first portion in contact with said supported area remote from the cutting edge of the respective cutting member and a second portion in contact with said supported area near the cutting edge of the respective cutting member, said first portion having a uniform cross-sectional area, seen perpendicularly to the longitudinal direction, and said second portion having a reduced cross-sectional area compared to the uniform cross-sectional area of the first portion, wherein the second portion of the supporting member of at least one of the cutting members extends over at least half of said predetermined distance.

2. A shaving head as claimed in claim 1, wherein the second portion of the supporting member of each cutting member extends over at least half of said predetermined distance.

3. A shaving head as claimed in claim 1, wherein the second portion is a wedge-shaped portion.

4. A shaving head as claimed in claim 1, wherein the second portion is a toothed portion.

5. A shaving head as claimed in claim 4, wherein the toothed portion comprises wedge-shaped teeth.

6. A shaving device having a grip and a shaving head releasably mounted to the grip, wherein the shaving head is a shaving head as claimed in claim 1.

* * * * *